US009327186B1

(12) United States Patent
Pececnik

(10) Patent No.: US 9,327,186 B1
(45) Date of Patent: May 3, 2016

(54) ROULETTE SYSTEM WITH SIDE BET AND RANDOM MULTIPLIER EVENT

(71) Applicant: Joze Pececnik, Smarca (SI)

(72) Inventor: Joze Pececnik, Smarca (SI)

(73) Assignee: INTERBLOCK D.D., Menges (SI)

( * ) Notice: Subject to any disclaimer, the term of this patent is extended or adjusted under 35 U.S.C. 154(b) by 0 days.

(21) Appl. No.: 14/714,253

(22) Filed: May 16, 2015

(51) Int. Cl.

| | |
|---|---|
| ***A63F 5/00*** | (2006.01) |
| ***G07F 17/32*** | (2006.01) |
| *A63F 1/00* | (2006.01) |
| *A63F 5/02* | (2006.01) |

(52) U.S. Cl.
CPC ..... *A63F 5/0088* (2013.01); *G07F 17/3244* (2013.01); *A63F 5/00* (2013.01); *A63F 5/0005* (2013.01); *A63F 5/02* (2013.01); *A63F 2001/008* (2013.01)

(58) Field of Classification Search
CPC ..... A63F 5/0088; A63F 5/0005; A63F 5/00; A63F 5/02; A63F 2003/00164; A63F 2003/00167; A63F 2003/0017
USPC ..... 273/142 R, 142 E–142 H, 142 HA, 142 J, 273/142 JA–142 JD
See application file for complete search history.

(56) References Cited

U.S. PATENT DOCUMENTS

| | | | | |
|---|---|---|---|---|
| 5,042,810 | A | 8/1991 | Williams | |
| 5,718,431 | A | 2/1998 | Ornstein | |
| 5,743,798 | A | 4/1998 | Adams et al. | |
| 5,743,800 | A | 4/1998 | Huard et al. | |
| 5,755,440 | A | 5/1998 | Sher | |
| 7,669,850 | B1 * | 3/2010 | Miller | A63F 3/00157 273/143 R |
| 8,177,234 | B2 | 5/2012 | Nicely et al. | |
| 2003/0094752 | A1 | 5/2003 | Mathews et al. | |
| 2005/0003885 | A1 | 1/2005 | Rhoten et al. | |
| 2005/0192076 | A1 | 9/2005 | Lowery et al. | |
| 2006/0237905 | A1 * | 10/2006 | Nicely | A63F 3/00157 273/274 |
| 2007/0246883 | A1 * | 10/2007 | Cudlipp | G07F 17/3213 273/144 R |
| 2008/0132315 | A1 | 6/2008 | Fisher et al. | |
| 2009/0283967 | A1 * | 11/2009 | Stergides | G07F 17/3286 273/142 E |
| 2010/0227665 | A1 | 9/2010 | Nicely et al. | |
| 2011/0059785 | A1 * | 3/2011 | Scalisi | A63F 5/00 463/17 |
| 2013/0316799 | A1 | 11/2013 | Hsu et al. | |
| 2015/0087377 | A1 | 3/2015 | Yee et al. | |

* cited by examiner

*Primary Examiner* — Benjamin Layno
(74) *Attorney, Agent, or Firm* — Mark A. Litman & Associates, P.A.

(57) ABSTRACT

A wagering system having: a physical roulette wheel; a source of multiple drop balls; a selection system that selects a single drop ball from a roulette ball storage area; and the roulette ball storage area storing a first roulette ball of a first color in a first accessible area and storing a second roulette ball of a second color in a second accessible area. The processor recognizing wagers on roulette wagering event outcomes and side bets placed at a player position on roulette wagering event outcomes. The processor is configured to resolve wagers at a player position with the side bet being recognized on roulette wagering event outcomes that do occur at odds against a second paytable with odds on at least some winning event outcomes that are higher than odds on the same at least some winning event outcomes without a side bet.

18 Claims, 7 Drawing Sheets

222
214
216
220
218
208
402
9
204
210
212
202
$987654.00
$7777.00
$222.00
1 OF 12
1 OF 12
1 OF 12
1 OF 18
EVEN
ODD
18 OF 36
2 TO 1
2 TO 1
2 TO 1

ROULETTE SYSTEM WITH SIDE BET AND RANDOM MULTIPLIER EVENT

BACKGROUND OF THE INVENTION

1. Field of the Invention

The present invention relates to the field of gaming, particularly roulette gaming and the use of side bets having unique apparatus enabling novel gaming methods.

2. Background of the Art

Roulette is a popular wagering game played in casinos and other gaming establishments. Avid players are generally open to, and sometimes specifically seek out, new and more interesting ways to play roulette, particularly when the reward for a winning outcome at the end of a round of play, or the odds of achieving a winning outcome, may be enhanced. For example, U.S. Pat. No. 5,743,798 (Adams et al.) discloses a progressive side bet for roulette that a player wins when the player bets on the same winning number four times in a row, an amount of the winnings being a fixed amount that grows with successive rounds; a progressive pot, less a rake; or a randomly selected amount. Similarly, U.S. Pat. No. 5,042,810 (Williams) discloses a progressive side bet for roulette that a player wins when the same winning number occurs three and four games in a row, an amount of the winnings being an amount accumulated in a progressive pot.

U.S. Pat. No. 5,743,800 (Huard et al.) discloses a progressive side bet applicable to roulette that a player wins when a randomly selected number is the winning number or when the player is simply randomly selected from a number of players or player positions, which may further involve randomly selecting the amount of the prize as a fixed amount or as a percentage of a progressive pot.

U.S. Pat. No. 5,718,431 (Ornstein) discloses a streak side wager for roulette that a player wins when the player achieves a preselected number of consecutive wins on the same conventional roulette wager (e.g., odds, evens, red, black, split, box, specific number, etc.).

U.S. Patent App. Pub. No. 2005/0192076 (to Lowery) discloses a side bet for roulette that a player wins a fixed amount when a preselected outcome occurs in two consecutive rounds.

U.S. Patent App. Pub. No. 20150087377 (Yee) discloses methods of administering games of roulette. A multiplier may be randomly selected from a group of fixed multipliers for a payout on the wager. A number and associated color may be randomly generated from within a range of numbers and associated colors. The wager may be resolved by determining whether the randomly generated number is identical to a randomly generated number from an immediately preceding round. A payout may be paid to the player when the randomly generated number is identical to the randomly generated number from the immediately preceding round, an amount of the payout being equal to an amount of the wager multiplied by the randomly selected multiplier. The amount of the wager may be collected for the house when the randomly generated number is different from the randomly generated number from the immediately preceding round.

U.S. Patent App. Pub. No. 20080132315 (Fisher) discloses a roulette apparatus that enables and enhances roulette gaming. The roulette apparatus comprises a roulette wheel assembly, a ball-delivery tower, ball-conducting conduit, and disguised wheel monitoring equipment. The ball-delivery tower comprises a tower support portion and a tower arm. The tower arm may enclose and partially disguise the wheel-monitoring equipment. The tower support portion provides a certain vertical dimension for maximizing roulette ball potential energy.

The ball-conducting conduit extends intermediate a ball inlet and a ball outlet. The ball outlet is positioned for outletting the roulette ball upon an upper wheel surface of the roulette wheel assembly. The tower and the ball-conducting conduit convert roulette ball potential energy to roulette ball kinetic energy and further function to effect a self-launching roulette ball for enhancing the roulette gaming experience.

U.S. Pat. No. 5,755,440 (Sher) discloses an Enhanced Roulette-Style Game in which a new Roulette apparatus comprising multiple balls and separate tracks for launching each of the balls. In a preferred embodiment there are two balls and two tracks, and a special apparatus for launching the balls. In one embodiment the launching apparatus is air powered, and in another the apparatus is mechanical with the balls accelerated by contact with a spinning wheel. In either case the launching apparatus may be hand-held or mounted to a frame and positioned to propel the balls into the tracks.

U.S. Patent App. Pub. No. 20050003885 (Rhoten) discloses an improved roulette type game in which an electronic Start signal triggers a Launch signal, but only after an electronically generated random time delay.

U.S. Patent App. Pub. No. 20100227665 (Nicely) discloses a gaming device including a game operable upon one or more wagers. The game is operable for a first play and a second play. Each one of the plays involves a spin of a rotor. The rotor has a plurality of symbols and a plurality of ball landings adjacent to the symbols. A first quantity of the ball landings is available for the first play, and a lower, second quantity of the ball landings is available for the second play. The gaming device also includes an indicator that is operable to indicate information relating to the availability of the second quantity of ball landings. In one embodiment, a plurality of different colored balls are used in accordance with a plurality of matching colored ball landings. If a green ball, for example, lands in a green landing, the subsequent play could begin, wherein each green landing would be eliminated or deactivated in the subsequent play.

U.S. Patent App. Pub. No. 20030094752 (Matthews) describes a method for playing a roulette-type game includes the initial step of providing a playing field for betting on the conclusions of a plurality of gaming trials, prior to initiating the plurality of trials. In order to associate each table with one ball, it is preferred that each table have a colored top matching the color of the particular ball. Thus one table may be identified as a blue table and is associated with a blue colored ball. Another table 44 is red and is associated with a red ball, etc. A vertical electronic display post is provided for each table and is located proximal the roulette wheel and each table. Each post has electronic display apparatus for displaying the number of the pocket within which the associated colored ball falls during play of the game.

U.S. Patent App. Pub. No. 20130316799 (Hsu) discloses an incentive apparatus for a gambling game system aims to increase the odds thereof. The gambling game system includes a betting table and a plurality of game results. The betting table has payout odds marked thereon corresponding to different game results of the gambling game system. The incentive apparatus includes a dynamic raised odds calculation element, an electronic display board and a payout element. The dynamic raised odds calculation element randomly selects a specific number of the game results and generates dynamic raised odds for the selected game results respectively. The electronic display board has a plurality of display zones corresponding to the game results. The display zones immediately display the dynamic raised odds after betting of each round of game stops. The payout element pays out to players Who win the round of the game according to the payout odds or the dynamic raised odds. The gambling game system also can be Roulette with a roulette wheel and a colored ball. The betting table also can be a physical table or the betting table can be an electronic interface.

All disclosures cited herein are incorporated in their entirety. Further advances in roulette gaming technology are still desired within the industry.

SUMMARY OF THE INVENTION

A roulette-based wagering system includes: a) a physical roulette wheel; b) a source of multiple drop balls (multiple including at least two balls of different colors); a selection system that selects a single drop ball from a roulette ball storage area for use in a roulette wagering event. The roulette ball storage area stores at least a first roulette ball of a first color in a first accessible area (an assembly area or individual storage area) and storing a second roulette ball of a second color in a second accessible area. The wagering system may be played manually, but it is preferred that a more completely automated system include a processor having a random number generator. The processor is configured to control most aspects of the roulette-based wagering event. For example, the processor may be configured to cause the selection system to randomly select for the next wagering event only one roulette ball selected from at least a first color or a second color for use in a single event of roulette. In the wagering event, the roulette wheel is spun and the only one roulette ball is delivered (preferably automatically) onto a track on the spinning roulette wheel to determine a roulette wagering event outcome when the only one roulette ball stops at a numbered position on the roulette wheel. The positions are numbered and colored according to standard or variant roulette markings. Again, although manual systems are enabled herein, the more automated systems in which the processor is configured to recognize wagers on roulette wagering event outcomes and side bets placed at a player position on roulette wagering event outcomes. The processor is preferably further configured to resolve electronically sensed or electronically entered wagers as follows:

- side bet wagers are always forfeit when placed (The side bet is preferably not directly a basis for odds payout, but merely causes the side bet event to be active at the player position where the side bet has been placed.);
- wagers on roulette wagering event outcomes that do not occur are forfeit;
- wagers at a player position without the side bet being recognized on roulette wagering event outcomes that do occur are resolved at odds against a first paytable; and
- wagers at a player position with the side bet being recognized on roulette wagering event outcomes that do occur are resolved at odds against a second paytable that provides odds on at least some winning event outcomes that are higher than odds on the same at least some winning event outcomes in the first paytable.

BRIEF DESCRIPTION OF THE FIGURES

FIG. 2 is a representation of a side view of the available balls for selection in a ball storage area

DETAILED DESCRIPTION OF THE INVENTION

Figure 1:
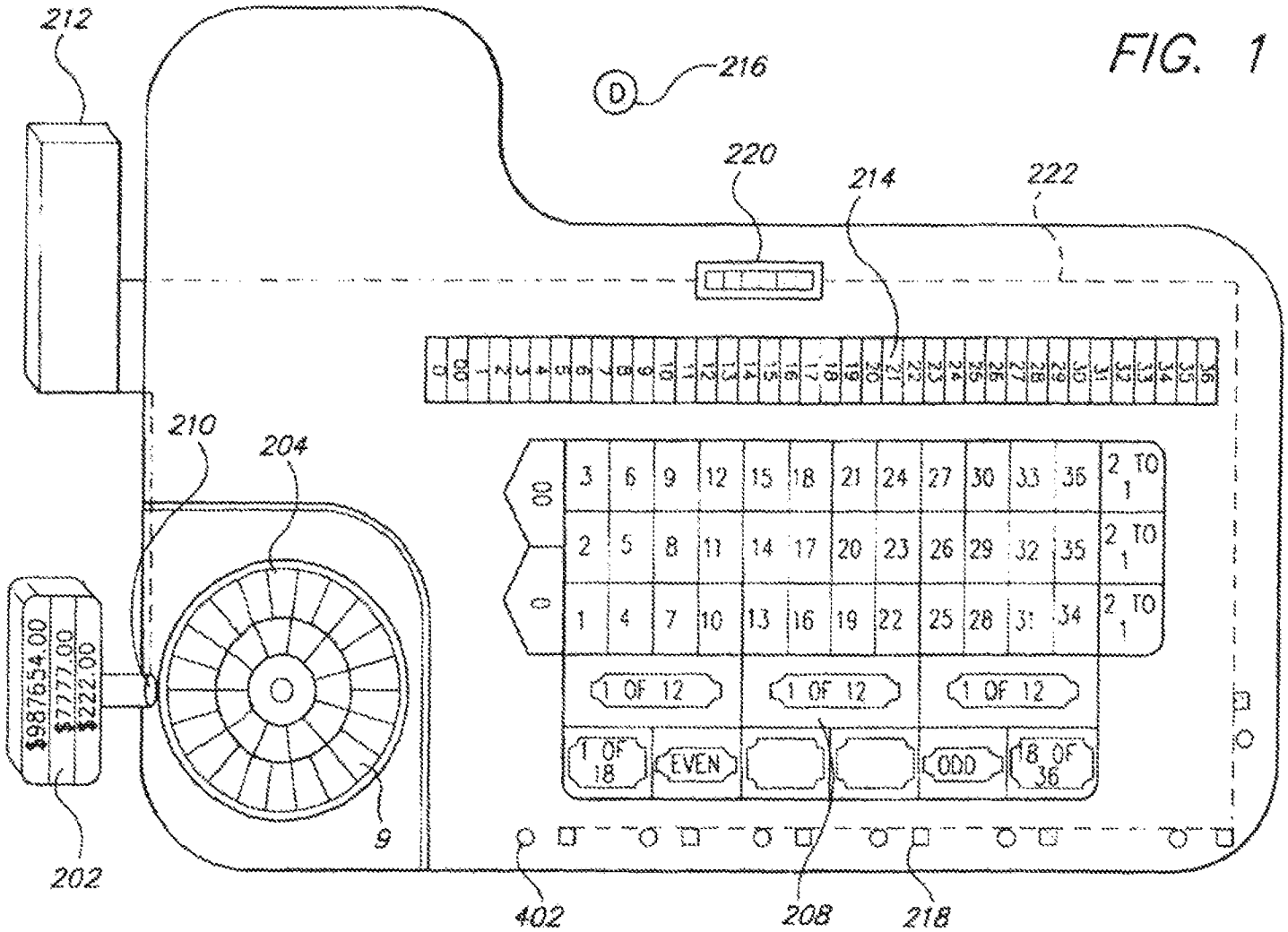
FIG. 1 is a roulette table in accordance with the Prior Art with standard wagering information and positions
Figure 1:
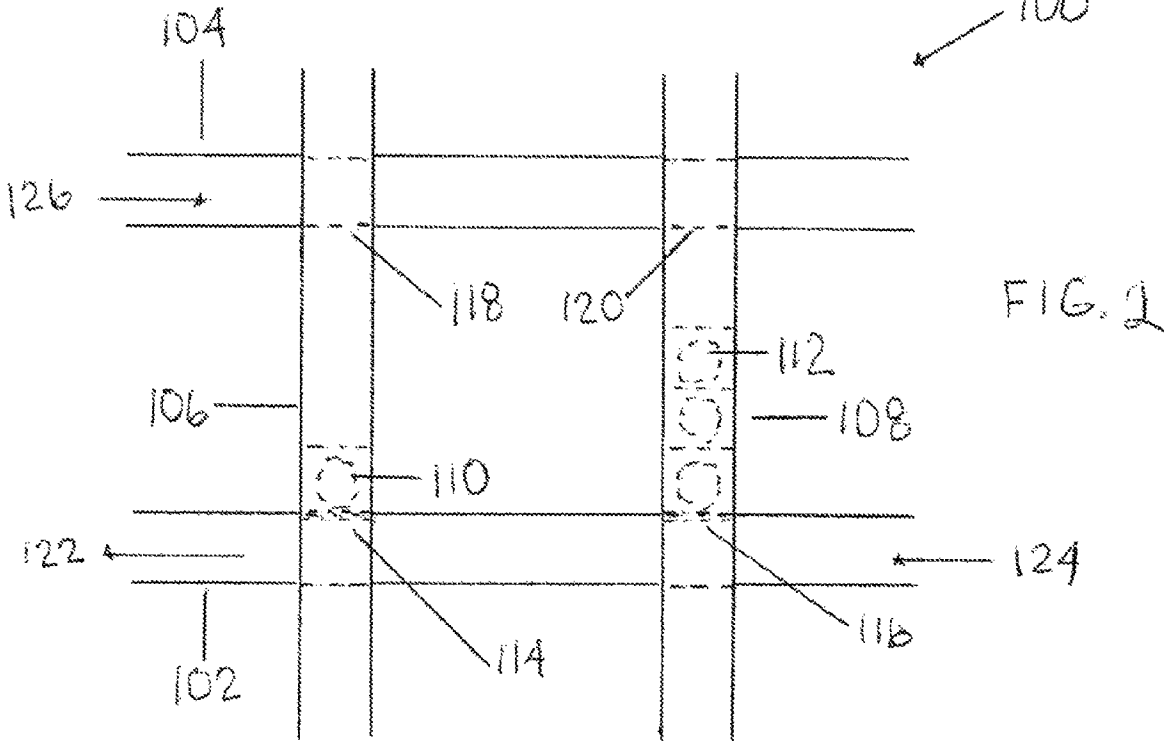

A roulette-based wagering system includes:

a) a physical roulette wheel. A standard or variant wheel design may be used. Variant wheel designs include, by way of non-limiting examples, multi-wheel roulette systems and where the wheel supporting the set of pockets spins independently of the set of alphanumerics as disclosed in Published US Patent Application Document No. 20140015194 (Pececnik). Underlying roulette wagers and odds may typically remain the same as normally played in roulette wagering events. The roulette system may be fully enclosed (with a transparent cover or bubble over the wheel at all times) or the system may be uncovered. The system may be fully automatic, or may have a croupier/dealer who receives random balls and manually spins the wheel and ball. As noted elsewhere, when the ball color is visible, all side bets must be closed, and even standard wagers may be closed to prevent players from taking advantage of knowledge of the activity available on the side bet.

b) a source of multiple drop balls (multiple including at least two balls of different colors); a selection system that selects a single drop ball from a roulette ball storage area for use in a roulette wagering event. The roulette ball storage area stores at least a first roulette ball of a first color in a first accessible area (an assembly area or individual storage area) and storing a second roulette ball of a second color in a second accessible area. After random selection of an individual ball, the ball(s) may be transported by existing roulette ball transport technologies. Those technologies include, by way of non-limiting examples, air-driven transport tubes, belt conveyor systems, mechanical claw grips, and combinations thereof.

The wagering system alternatively may be played manually, but it is preferred that a more completely automated system include a processor having a random number generator. In either case, whether the ball is dropped manually or automatically, wagers are closed on the side bet as soon the color of the active (randomly selected) ball is visible. In theory, the wagering can remain open (as it does in many roulette systems) when a standard ball (one that does not alter the odds) is viewed. That open wagering period remains until the ball speed or wheel speed decreases to a particular limit.

The processor is configured to control most aspects of the roulette-based wagering event. For example, the processor may be configured to cause the selection system to randomly select for the next wagering event only one roulette ball selected from at least a first color or a second color for use in a single event of roulette. In the wagering event, the roulette wheel is spun and the only one roulette ball is delivered (preferably automatically) onto a track on the spinning roulette wheel to determine a roulette wagering event outcome when the only one roulette ball stops at a numbered position on the roulette wheel. The positions are numbered and colored according to standard or variant roulette markings. Again, although manual systems are enabled herein, the more automated systems in which the processor is configured to recognize wagers on roulette wagering event outcomes and side bets placed at a player position on roulette wagering event outcomes. The processor is preferably further configured to resolve electronically sensed or electronically entered wagers as follows:

side bet wagers are always forfeit when placed (The side bet is preferably not directly a basis for odds payout, but merely causes the side bet event to be active at the player position where the side bet has been placed.);

wagers on roulette wagering event outcomes that do not occur are forfeit;

wagers at a player position without the side bet being recognized on roulette wagering event outcomes that do occur are resolved at odds against a first paytable; and wagers at a player position with the side bet being recognized on roulette wagering event outcomes that do occur are resolved at odds against a second paytable that provides odds on at least some winning event outcomes that are higher than odds on the same at least some winning event outcomes in the first paytable.

The wagering system may have the selection system also return the only one roulette ball to the appropriate storage area for the only one roulette ball. The wagering system may also have the processor provide different weighted probabilities between the first color ball (referred to as a "standard ball" which will not activate bonus payouts or a higher odds paytable) and the second color ball (referred to as the "colored ball" or "bonus ball" which activates the bonus payouts and/or higher odds paytable). As with mapping of frames in reel, the probability of a colored bonus ball or standard ball being selected is probability weighted. The random number generator, for example, may store 1 million numbers for a selection base. Of those million numbers, one of which is randomly selected at the beginning of each roulette wagering event, the distribution of those numbers is not even. For example, to attain a probability of 9:1 for the standard ball versus the colored bonus ball being selected, 900,000 of the available numbers will indicate to the processor that the standard ball is to be selected and provided to the roulette event and 100,000 of the available numbers will indicate to the processor that the bonus ball will be selected and provided to the roulette event. The distribution of weighted probabilities may be adjusted by increments as small as 1 to effect subtle or dramatic changes in probabilities for the bonus ball being selected. Thus, house hold resulting from the side bet wagers may be subtly adjusted by modification of the mapping for the balls fed to the random number generator.

The wagering system may have each player position provided with a player position input system (e.g., terminal, buttons, touchscreen, tablet, pad, laptop communication system, or combinations thereof) enabling entry of both a wager on roulette wagering event outcomes and a wager on the side bet.

The wagering system may be configured wherein upon indication of entry of both a wager on roulette wagering event outcomes and a wager on the side bet, the processor is configured to decrement credits at the player position by an amount of the wager on roulette wagering event outcomes and a fixed amount for the wager on the side bet. That is, rather than requiring a separate entry for a specific amount for the side bet on the color ball event, when any wager is made from a player position (a single wager or combination of wagers), a percentage or an absolute amount is decremented from the player position credit account and irrevocably transferred out of the player account. For example, if a single $10.00 line wager is made, the processor also decrements the credit account by way of a non-limiting example an additional 10% when the side bet event on the bonus ball is selected by the player. The wager on the line bet remains at $10.00, and only the $10.00 is considered if a winning outcome occurs. Similarly, if the player position make 6 different wagers (e.g., on individual numbers, adjacent numbers, columns, colors, etc.) totaling $22.00, the processor will decrement the player credit account by (for example) 10% or $2.20. The percentage may vary, or an absolute amount may be withdrawn, regardless of the size of total wagers. For example, if the minimum required wager during any round of roulette play is $5.00, and the maximum total wager allowed is $300 on any round, either a specific wager amount (e.g., $1.00, $2.00, $5.00, etc.) may be required, or there may be stepped decrement with ranges of total wagers (e.g., $1.00 decrement for any wagers between $5.00 and $20.00; $2.00 decrement for any wagers between $20.01 and $40.00; $3.00 decrement for any wagers between $40.01 and $60.00, etc.). The wagering system may have the processor configured to base the predetermined percentage on total wagers placed at the player position on a next roulette wagering event outcome, or the processor is configured to base the predetermined percentage on a highest amount of any single wager placed at the player position on a next roulette wagering event outcome, or the processor is configured to base the predetermined percentage on a minimum allowable total wager allowed on a next roulette wagering event outcome, or the processor is configured to base the predetermined percentage on an average of all wagers placed at the player position on a next roulette wagering event outcome. The wagering system may enable visible indication of entry of both a wager on roulette wagering event outcomes and a wager on the side bet, the processor is configured to decrement credits at the player position by an amount of the wager on roulette wagering event outcomes and at least one of a) a fixed amount for the wager on the side bet or b) a fixed percentage of the amount of the wager on roulette wagering event outcomes.

The wagering system may have the processor configured to provide different weighted probabilities between the first color ball and the second color ball at rates of weighted probabilities between 8:1 and 25:1. The wagering system may have the processor provide different weighted probabilities between the first color (standard color) ball and the second color (bonus) ball. The different weighting may be automatically varied based on time of day, level of play, or other parameters.

The wagering system may enable that both delivery of the only one roulette ball onto a track on the spinning roulette wheel and return of the only one roulette ball to the appropriate storage area for the only one roulette ball is configured to be performed by apparatus directed by the processor. The wagering system may configure the processor to provide different weighted probabilities between the first color ball and the second color ball and wherein both delivery of the only one roulette ball onto a track on the spinning roulette wheel and return of the only one roulette ball to the appropriate storage area for the only one roulette ball is configured to be performed by apparatus directed by the processor.

With reference to FIG. 1, there is shown a roulette table in accordance with the Prior Art with standard wagering information and positions that may be used in the practice of the underlying play of the present invention comprising a wheel 204 and a conventional betting layout 208 (also known as a register, board or chart) wherein in addition to the conventional betting layout 208, a progressive jackpot betting layout 214 typically smaller in size of the conventional betting layout is placed on the table felt. The dealer is located at position 216, and the players take positions across the table from the dealer in front of slots 218.

The wagering layouts 208, 214 are conventionally placed on the felt by a screen printing method. However, other methods of adhering a progressive jackpot layout 214 may be used. For example, a Velcro® attachment may be employed. Further, the progressive jackpot layout 214 need not be a design shown in FIG. 1. It may have other shapes and designs such as a race track design.

In accordance with the present invention, a player occupies one of a number of player positions (typically 7-positions) at the roulette table. The table also has a number of mutually distinctive sets of chips equal to the maximum number of player positions with each chip having the same value.

Each player is assigned a different one of the sets as a source of chips; and may bet the chips on one or more numbers on the conventional betting layout 208.

Thus in one form, each one of the mutually distinctive sets of chips has both value chips and non-value chips. Each player in this embodiment uses value chips to bet on one or more numbers on the conventional betting layout. Each player may also bet on one or more numbers on the progressive jackpot betting layout, but each player is limited to a single non-value chip wager on each number bet on the progressive jackpot betting layout 214.

FIG. 2 is a representation of a side view of the available balls for selection in a ball storage area 100. Shown are the ball return tube 102 for carrying individual randomly selected balls (e.g., from among bonus ball 110 or standard balls 112) to a drop position onto the roulette wheel (not shown). A return tube 104 for returning balls from the roulette wheel is shown, the balls being appropriately returned to a bonus ball storage column or rack 106, and the standard balls being returned to the standard ball storage column or rack 108. Drop control open/close elements 118 and 120 are shown for respective bonus ball storage column or rack 106 and the standard ball storage column or rack 108. Processor (not shown) controlled respective support and release gates 114 and 116 for the respective bonus ball storage column or rack 106 and the standard ball storage column or rack 108 are also shown. Upon the random number generator and the processor determining what type of ball is to be dropped in the next roulette wagering event, the processor directs opening of the appropriate gate 114 or 116 so that the air flow 124 entering ball return tube 102 moves the selected ball out of the tube 102 in air flow direction 122 to the roulette wheel ball drop component. Air flow direction or sloped tube direction 126 return balls to the appropriate drop control open/close elements 118 and 120 for respective bonus ball storage column or rack 106 and the standard ball storage column or rack 108. Multiple standard balls 112 are shown in storage area 108 as illustrative. As the standard balls are used with greater frequency than the bonus ball, the ability to store multiple balls, especially multiple standard balls can be within the system to reduce frequency of ball replacement in the system.

In general terms with respect to roulette play, in some embodiments, methods of administering games of roulette may involve accepting a wager from a player. A random multiplier selection apparatus may be used to randomly select from among different color balls that identify a multiplier from a group of fixed multipliers for a payout on the wager. A random outcome generation apparatus may be used to randomly generate a number and associated color ball from within a range of numbers and associated colors (at least two, but preferably no more than four).

In other embodiments, gaming tables for administering games of roulette may include a playing surface including at least one player interface for at least one player position, an operator interface, and at least one processor. The at least one processor may be programmed to: accept a wager from a player; randomly select a multiplier from a group of fixed multipliers indicated by different color balls that may be injected onto the spinning wheel for a payout on the wager; randomly generate a number and associated color ball within a range of numbers and associated color balls; resolve the wager by determining the roulette event outcome and whether the randomly generated number provides a bonus ball for players who have made the side bet wager; authorize payment of a payout to the player, an amount of the payout being equal to an amount of the winning wager multiplied by any bonus provided by the occurrence of the bonus ball; and authorize collection of the amount of the wager for the house when no winning outcome occurs with an underlying roulette outcome event.

In still other embodiments, methods of administering games of roulette over networks may involve receiving at a user interaction server authorization from a player to allocate funds to a wager. A multiplier may be randomly selected at a game server from a group of fixed multipliers for a payout on the wager. The game server may randomly generate a number and associated color within a range of numbers and associated colors. The wager may be resolved by determining at the game server whether the randomly generated number is identical to a randomly generated number from an immediately preceding round. The game server may authorize payment of a payout to the player when the randomly generated number is identical to the randomly generated number from the immediately preceding round. An amount of the payout may be equal to an amount of the wager multiplied by the randomly selected multiplier. The game server may authorize collection of the amount of the wager for the house when the randomly generated number is different from the randomly generated number from the immediately preceding round.

In other embodiments, methods of administering play-for-fun games of roulette over networks may include sending from a user interaction server a quantity of valueless wagering elements usable within a predetermined time period to a player. Authorization from a player may be received at the user interaction server to allocate at least one valueless wagering element to a wager. A game server may randomly select a multiplier from a group of fixed multipliers for a payout on the wager. The game server may randomly generate a number and associated color within a range of numbers and associated colors. The wager may be resolved by determining at the game server whether the underlying wager is won on the roulette wagering event outcome and whether the bonus ball event is active. A quantity of the additional valueless wagering elements may be equal to the quantity of valueless wagering elements allocated to the wager multiplied by the randomly selected multiplier. The game server may authorize deduction of the quantity of valueless wagering elements allocated to the wager when there is no winning underlying roulette outcome event.

In yet other embodiments, methods of administering roulette games over networks may involve receiving at a user interaction server authorization from a player to receive a roulette wager and to receive a separate side bet wager on the occurrence of a bonus ball color. The exact amount won is determined by randomly selecting a multiplier bonus ball and applying the multiplier to the amount of the wager. A user interaction server may accept an election to make a roulette wager on a selection of a number and color combination within a range of number and color combinations from the player. The user interaction server may also receive a wager on the occurrence of a next number and color combination being identical to the last consecutive game outcome. After receiving an authorization to receive the side wager, a game server may randomly select a multiplier from a group of fixed multipliers for a payout on the side wager, prior to or while randomly selecting and displaying the next roulette game outcome. The game server may randomly generate a number and associated color within a range of numbers and associated colors. An amount of the payout may be equal to an amount of the wager multiplied by the color ball determined multiplier.

Further embodiments may include one, some, or all of the following: The acts of the dealer or other operator may be carried out by a visual representation of a dealer, the visual representation being generated and/or displayed by a computer. The visual representation may be a virtual person (e.g., an animation), or may be a transmission (e.g., a video) of an actual person. The visual representation may be part of an online gaming experience of the disclosed game. The acts described in this disclosure associated with a dealer, including randomly generating a number and associated color (e.g., by introducing a ball onto a spinning roulette wheel or by activating an electronic random number generator), accepting or paying bets, or any other actions, may be represented in any way when used in an online environment. For example, the randomly generated numbers and associated colors generated by with a dealer action, described as being produced or otherwise initiated by a dealer, may appear as highlighted spaces on a virtual roulette wheel, as transmitted pictures of playing cards representing results achievable using a conventional physical roulette wheel, or as plain or colored text. This may include a display of a virtual roulette wheel where each space on the roulette wheel, with its associated number and color, is displayed to an online player in a manner consistent with the game play disclosed herein, but may or may not include a visual representation of a dealer with the roulette wheel. Likewise, betting activity may be displayed in any manner to a player, including, but not limited to, virtual chips, betting pools, numbers, or other indicia of a bet amount.

The online experience may involve players playing remotely (e.g., in a different physical location) from the dealer, remotely from the location of a game server, or remotely from both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment.

Live, electronic, or online implementations of the methods described in this disclosure may be configured for administration as either "play-for-pay" embodiments or "play-for-fun" embodiments. In play-for-pay embodiments, wagers having real-world monetary value are received and payouts having real-world monetary value may be distributed. Play-for-pay embodiments include "house-banked" embodiments and "player-banked" embodiments. In house-banked embodiments, payouts are paid by, and losses are retained by, the game administrator (e.g., a casino or other gaming establishment). Play-for-fun embodiments (e.g., "free play-for-fun" configurations and "social play-for-fun" configurations) involve receiving wagers having no real-world monetary value and distribute payouts having no real-world monetary value.

The actions described in this disclosure as the acts of a player, including betting and any other actions, may be carried out over a network where the indicated actions are received as input to a device. The input-receiving device is typically physically remote from the game server or game host and is connected over a long-distance network, but may also be implemented over a wired or wireless LAN in one building, or even in one room, for example. In one embodiment, game play generated at the server or host location may be displayed on the same device as the receiving device. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, touch screens, buttons, mice, optical location devices, eye movement/location detectors, sound input devices, etc. When discussing a device, it is understood the device may comprise multiple components and be complex, including hardware components combined with firmware and/or software, and may itself be a subcomponent of a larger system.

In some embodiments, an electronic bet sensor (not shown) is provided to electronically recognize the placement of a chip of a fixed denomination. In other embodiments, the chip sensor can determine the denomination of the chip. In some embodiments, the wager can be any size within house limits.

Other wager areas may be the same as or similar to wagering areas described in U.S. patent application Ser. No. 13/631,598 for "SYSTEMS, METHODS, AND DEVICES FOR DISPLAYING HISTORICAL ROULETTE INFORMATION."

Figure 3:
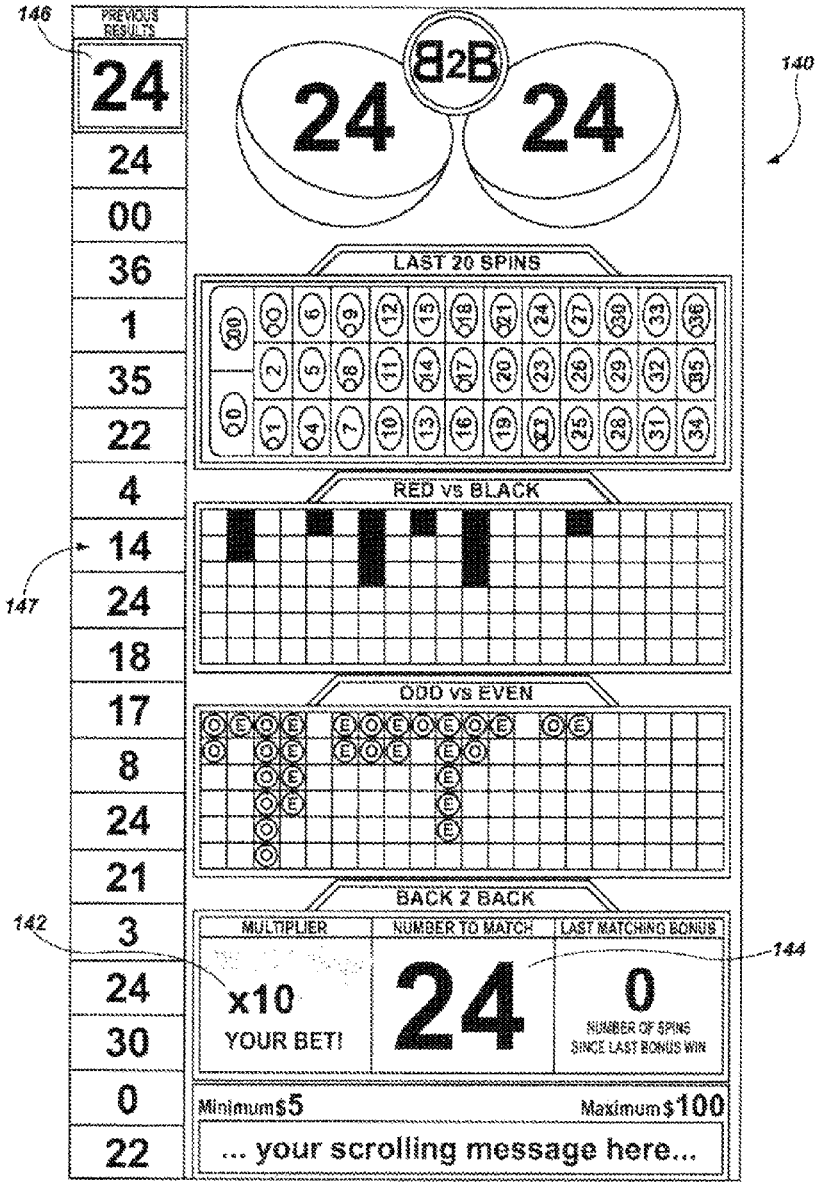
FIG. 3 is a diagram of an upright video display that may be used in connection with a roulette playing surface.

Referring to FIG. 3, illustrated is a diagram of an upright video display that may be used in connection with a playing surface for implementation of a method of administering a wagering game, according to another embodiment of the present disclosure.

The video display may include a display surface 140. The display surface 140 may include a multiplier selection area 142, which may be, for example, a section of a display electronically showing the result of the random selection of the multiplier in images, text, or images and text. The display surface 140 may display historical information on the outcomes of the game of roulette in multiple formats, as described in above-cited U.S. patent application Ser. No. 13/631,598. Briefly, the display surface 140 may display the numbers and colors for the current and preceding outcomes and may visually represent streaks in specific outcomes (e.g., 24 black, 36 red, etc.) and characteristics of outcomes (e.g., odds, evens, red, black, green). The display 140 may have a vertical column 143 of historical game outcomes, in the order in which the outcomes occurred, the newest being at the top of the column. The display surface 140 may include an immediately preceding outcome area 144, which may display the color ball outcome for a player to win the wager. The display surface 140 may further include an outcome area 146 within area 143, which may display the outcome of the current round of the game of roulette.

In some embodiments, the wagering games described herein may be played against the game administrator, i.e., "the house" (i.e., be "house-banked"), which may involve the game administrator (e.g., a casino or other gaming establishment) receiving (via a dealer who may be employed by the administrator) wagers having real-world monetary value, comparing a player hand against a dealer hand, distributing payouts having real-world monetary value to winning players, and retaining lost wagers. For example, and referring collectively to FIGS. 2 and 3, a wager may be accepted from a player, which may be reflected by the presence of a chip or an image of a chip in the wager area 130. A multiplier may be randomly selected by the random ball selection, which may be reflected, for example, by a needle 128 coming to rest and pointing toward a section 126 with its displayed multiplier or by electronically displaying the randomly selected bonus ball color in text, images, or text and images in a multiplier selection area 142 of an electronic display. A number and associated color may be randomly generated from within a range of numbers and associated colors, which may be reflected, for example, by a ball coming to rest in a section of a physical roulette wheel or by electronically displaying the randomly generated number and associated color in text, images, or text and images in an outcome area 146 of an electronic display.

Such embodiments may be implemented in the form of a live table game, a hybrid game utilizing a conventional roulette wheel on a table having electronic wagering interfaces, such as the system shown in U.S. Design Pat. D663785 issued Jul. 17, 2012 (the content which is hereby incorporated by reference in its entirety), in a virtual table game, in an electronic game, or in an online game configuration.

In some embodiments, wagering games may be administered without players risking money in connection with the wagers (i.e., "play-for-fun" games). Such games may be offered as online games, or as PC games such as those offered for downloading, or offered on a CD-ROM disc, for example. When a play-for-fun game is administered online, access to play-for-fun wagering games may be granted on a time period basis in some embodiments. For example, upon initially joining the online wagering game, each player may automatically be assigned a plurality of wagering elements, such as, for example, chips, points, or simulated currency, that is of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time another quantity of the wagering elements may be distributed to the player to permit the player to resume participation in the wagering game.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers, but may receive compensation through advertising revenue or through the purchase of access tokens redeemable for time compressions to continue play of the wagering game or simply to increase the quantity of wagering elements available to a player.

As another specific, non-limiting example, a social play-for-fun wagering game may comprise issuing a quantity of valueless wagering elements usable within a predetermined time period to a player. A player decision to allocate at least one valueless wagering element to a wager may be accepted. A multiplier may be randomly selected from a group of fixed multipliers for a payout on the wager. A number and associated color may be generated from within a range of numbers and associated colors. The wager may be resolved by determining at the game server whether the randomly generated number is identical to a randomly generated number from an immediately preceding round. Additional valueless wagering elements may be issued to the player when the randomly generated game outcome is identical to the randomly generated game outcome from the immediately preceding round. A quantity of the additional valueless wagering elements issued to the player may be equal to the quantity of valueless wagering elements allocated to the wager multiplied by the randomly selected multiplier. The quantity of valueless wagering elements allocated to the wager may be deducted when the randomly generated number is different from the randomly generated number from the immediately preceding round. A new quantity of valueless wagering elements usable within a new predetermined time period may be issued to the player, by accepting the player's redemption of an access token of no redeemable face value before the predetermined time period has lapsed.

Figure 4:
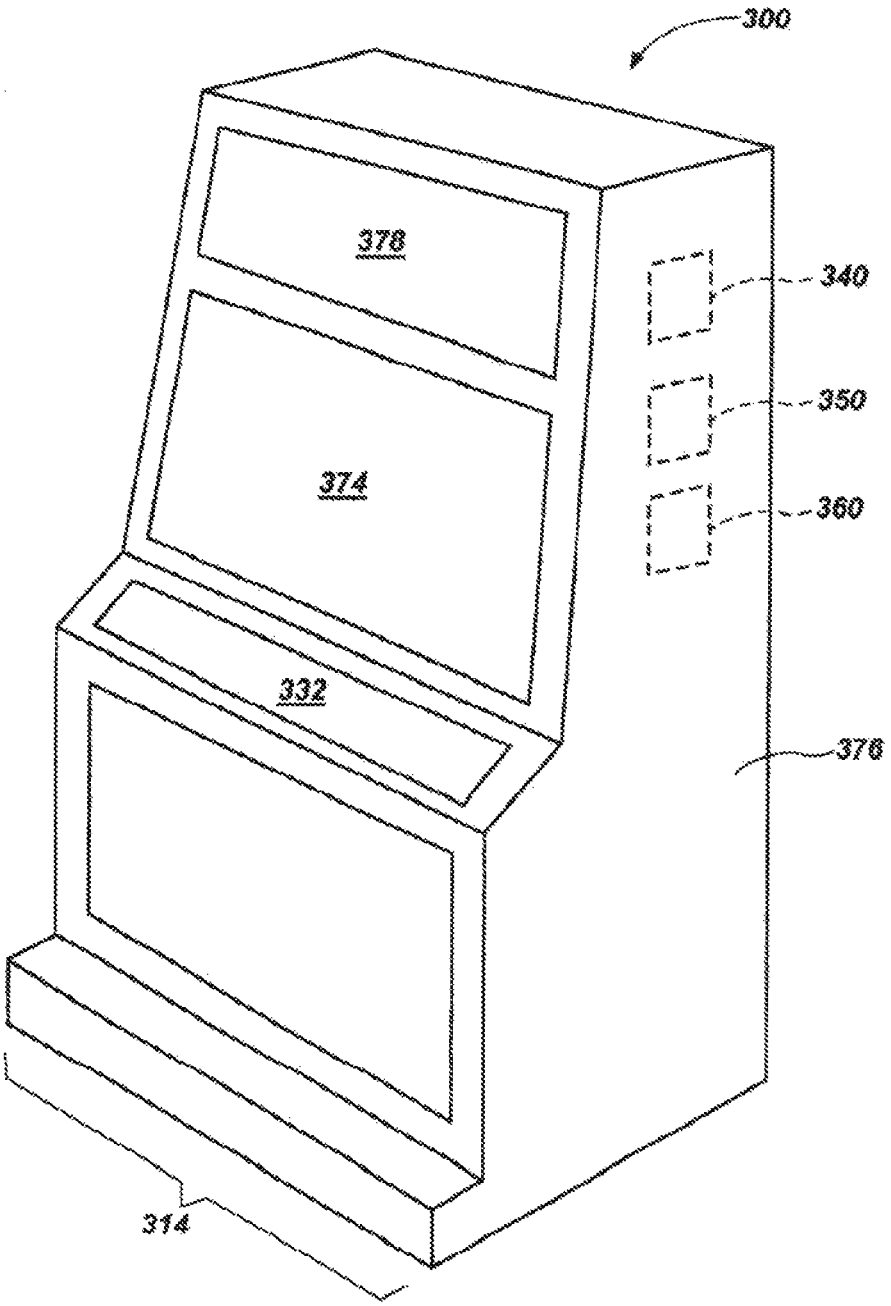
FIG. 4 is a rendition of an individual electronic gaming device configured for implementation of embodiments of wagering games according to the present disclosure.

Referring to FIG. 4, illustrated is an example of an individual electronic gaming device 300 (e.g., an electronic gaming machine (hereinafter, an "EGM") configured for implementation of embodiments of wagering games according to the present disclosure. The individual electronic gaming device 300 may include an individual player position 314 that includes a player input area 332 configured to enable a player to interact with the individual electronic gaming device 300 through various input devices. The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving a physical wheel, a physical ball or live personnel. The action may instead be simulated by a control processor 350 operably coupled to the memory 340 and interacting with and controlling the individual electronic gaming device 300. The EGM may also function as a player terminal to participate in a multi-player game administered by a dealer, the system having a community game outcome determining device, such as a roulette wheel. The system may have a community display for displaying game outcomes (not shown). An example of a suitable multi-player system is disclosed in U.S. Pat. No. 6,659,866.

Although the figure has an outline of a traditional gaming cabinet, the individual electronic gaming device 300 may be implemented in any number of ways, including, but not limited to, client software downloaded to a portable device, such as a smart phone, tablet, or laptop personal computer. The individual electronic gaming device 300 may also be a non-portable personal computer (e.g., a desktop or all-in-one computer) or other computing device. In some embodiments, client software is not downloaded but is native to the device or is otherwise delivered with the device when distributed to a player.

A communication device 360 may be included and operably coupled to the processor such that information related to operation of the individual gaming device 300, information related to the game play, or combinations thereof may be communicated between the individual gaming device 300 and other devices (not shown) through a suitable communication media, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown), and speakers (not shown) for transmitting and/or receiving sounds during game play. Further detail of an example of an individual electronic gaming device 300 (as well as other embodiments of tables and devices) is disclosed in U.S. Patent Publication No. 2013/0053117 titled "METHODS OF MANAGING PLAY OF WAGERING GAMES AND SYSTEMS FOR MANAGING PLAY OF WAGERING GAMES," the disclosure of which is incorporated herein in its entirety by this reference.

Some embodiments may be implemented at locations that include a plurality of player stations. Such player stations may include an electronic display screen for display of game information, such as displaying a virtual roulette wheel, virtual chips, credit meters, win amounts, wagers made and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual roulette wheel, virtual chips, etc.), some features may remain in the physical domain. As such, the game play may be administered by a live dealer, a virtual dealer, or a combination of both.

Figure 5A:
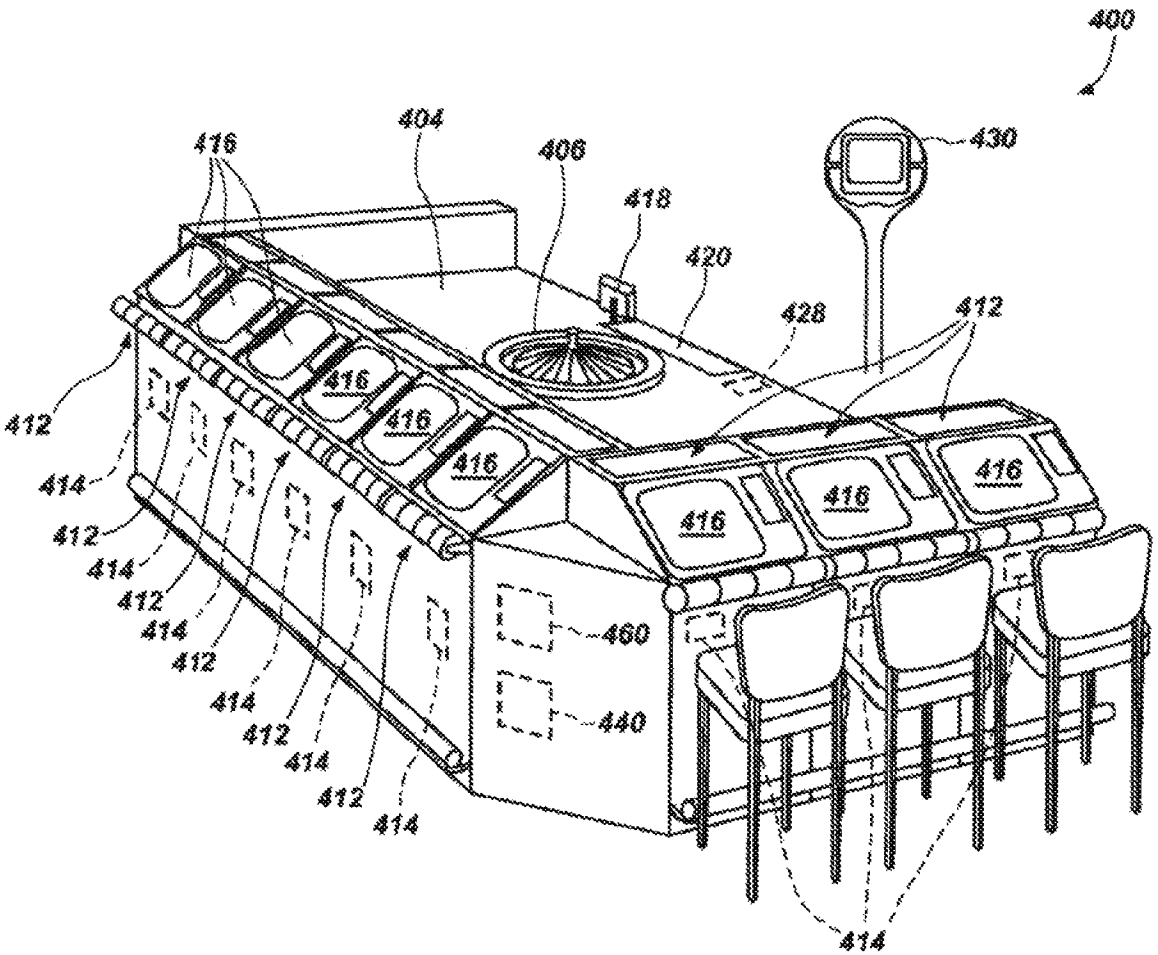
FIG. 5A is a rendition of a table configured for implementation according to the present disclosure.

Referring to FIG. 5, an example of a suitable table 400 configured for implementation of embodiments of wagering games according to the present disclosure is shown. The table 400 may include a playing surface 404, which may be, for example, a felt surface with a roulette wheel 406 mounted into the surface 404. The felt surface may include printed graphics or other information useful to the players or dealer. Embodiments (not shown) may enable players to make wagers with chips or other currency on the playing surface 404. In the displayed embodiment, only credit wagering is enabled. In embodiments that permit wagering on a community playing surface (not shown), credit wagering may also be enabled on individual player interfaces or a community display.

When a community display is provided, a touchscreen surface may be used for display of, and in some embodiments, interaction with, information regarding the wagering game (e.g., wagers accepted, historical information, current round information, etc., as described previously in connection with FIGS. 2 and 3).

The table 400 as shown in FIG. 5 may include a plurality of player stations 412. Each player station 412 may include a separate player interface 416, which may be used for accepting wagers, displaying game information (e.g., game instructions, input options, wager information including virtual chips, game outcomes, etc.). The player interface 416 may include a display screen in the form of a touch screen, which may be at least substantially flush with, or raised up from, the playing surface 404 in some embodiments. Each player interface 416 may be coupled respectively with its own local game processor 414 (shown in dashed lines), although, in some embodiments, a central game processor 428 (shown in dashed lines) may be employed and may communicate directly to player interfaces 416. In some embodiments, a combination of individual local game processors 414 and the central game processor 428 may be employed.

A communication device 460 and a non-transitory memory 450 may be included and may be operably coupled to one or more of the local game processors 414, the central game processor 428, or combinations thereof, such that information related to operation of the table 400, information related to the game play, or combinations thereof may be communicated between the table 400 and other devices (not shown) through a suitable communication media, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using virtual chips. For embodiments using physical roulette wheels 406, the table 400 may further include a spinning, physical roulette wheel 406 that may be configured to receive a ball or other indicator which may come to rest in individual, separate sections with numbers and colors therein to generate a random outcome for a round of roulette. For embodiments using virtual roulette outcome generation, the outcome may be displayed at the individual player interfaces 416 or on a common display 430.

The table 400 may further include a dealer interface 418, which, like the player interfaces 414, may include touch screen controls for assisting the dealer in administering the wagering game. The table 400 may further include an upright common display 430 configured to display images that depict game information, such as, for example, the information described previously in connection with FIGS. 2 and 3 and a wide variety of other information considered useful to the players, including a video display of each game outcome, in real-time. A camera (not shown) may be trained on the wheel 406 and video recordings of each wheel spin may be captured and displayed on the display 430. The upright display 430 may be double sided to provide such information to players as well as to the casino pit.

Figure 5B:
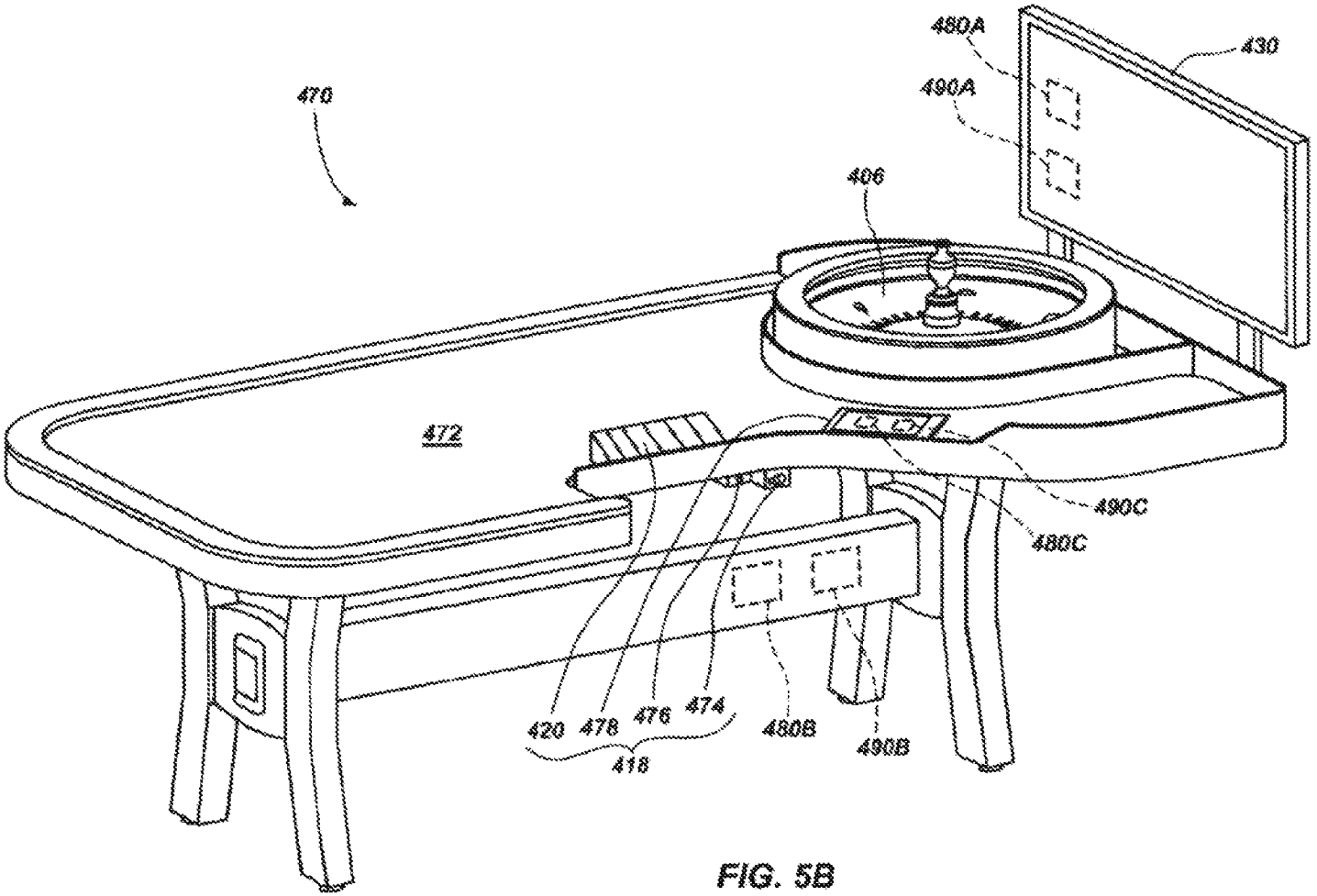
FIG. 5B is a perspective side view of another embodiment of a table configured for implementation of embodiments of wagering games in accordance with the present disclosure.

Referring to FIG. 5B, a perspective side view of another embodiment of a table 470 configured for implementation of embodiments of wagering games in accordance with the present disclosure. The table 470 may include a playing surface 472, which may be, for example, a felt layout similar to the playing surface 120 described previously in connection with FIG. 2. The table 470 may further include a physical roulette wheel 406 proximate to, and in some embodiments supported by, the playing surface 472. The table 470 may include a video display 430 configured to display game information, such as, for example, the information described previously in connection with FIGS. 2 and 3 and any other information considered useful to the players, including acceptance of wagers, game outcomes, wager outcomes, payout multipliers, historical game outcome data, and other information, in real-time.

The table 470 may include features for at least partially automating administration of a wagering game using the table 470. For example, the table 470 may include a dealer interface 418, which may enable an in-person administrator (e.g., a dealer) to initiate automated administration of certain actions and to personally perform other actions associated with administering a wagering game. The dealer interface 418 may include, for example, a dealer chip tray 420, which may be configured to support house chips, to which lost wager may be added, and from which payouts may be paid. The dealer interface 418 may include a player authenticator 474 (e.g., a magnetic strip reader for cards carrying player information encoded on a magnetic strip), which may be configured to verify the identity of a player and grant access to a player account for the purpose of paying payouts, granting complimentary items and services (i.e., "comps") to players, redeeming chips for monetary value and vice versa, or performing other actions requiring a player's verified identity. The dealer interface 418 may include game initiation and control devices, such as, for example, buttons 476 and touchscreens 478, which may be configured to initiate random game events (e.g., random payout multiplier selection), verify authorization for large payout awards, enter wagering or outcome information for the purpose of game tracking, activating and deactivating automated portions of game administration (e.g., turning the table 470 and associated components on and off), and performing other actions to initiate and control the automatic administration of the wagering game.

The table 470 may include at least one processor 480, which may be associated, for example, with the video display 430 (e.g., processor 480A), the table 470 itself (e.g., processor 480B), or the touchscreen 478 (e.g., processor 480C) of the dealer interface 418. The one or more processors 480 may access game rules and game assets (e.g., videos, images, and text) stored in at least one non-transitory memory 490, which may similarly be associated, for example, with the video display 430 (e.g., memory 490A), the table 470 itself (e.g., memory 490B), or the touchscreen 478 (e.g., memory 490C) of the dealer interface 418. For example, the one or more processors 480 may randomly select a payout multiplier, interpret a random game outcome, declare winning wager conditions, and control display of information on the video display 430.

At least some of the actions performed in connection with administering a wagering game using the table 470 may be accomplished by an in-person administrator. For example, wagers may be accepted by a dealer permitting a player to place a chip in a designated area on the playing surface 472, roulette outcomes may be randomly generated by the dealer introducing an indicator (e.g., a ball) into the spinning physical roulette wheel 406 and permitting it to come to rest on a space defined by the physical roulette wheel 406, and payouts may be paid by the dealer giving chips from a dealer chip tray 420 to a player, for example, by placing them on the playing surface 472 proximate the player. Other actions performed in connection with administering a wagering game using the table 470 may be accomplished automatically by one or more processors 480, which may occur in response to dealer input or may occur automatically in response to other game events. For example, one or more processors 480 may randomly select a payout multiplier in response to a dealer indicating that wagering is closed, may automatically select a payout multiplier randomly at the close of wagering or at the beginning of a new round of play, may automatically interpret a random game outcome (e.g., using sensors in the physical roulette wheel 406 or using imaging sensors configured to capture information from the physical roulette wheel 406), and may apply game rules and display all winning game conditions associated with the random game outcome on the video display 430.

Figure 6:
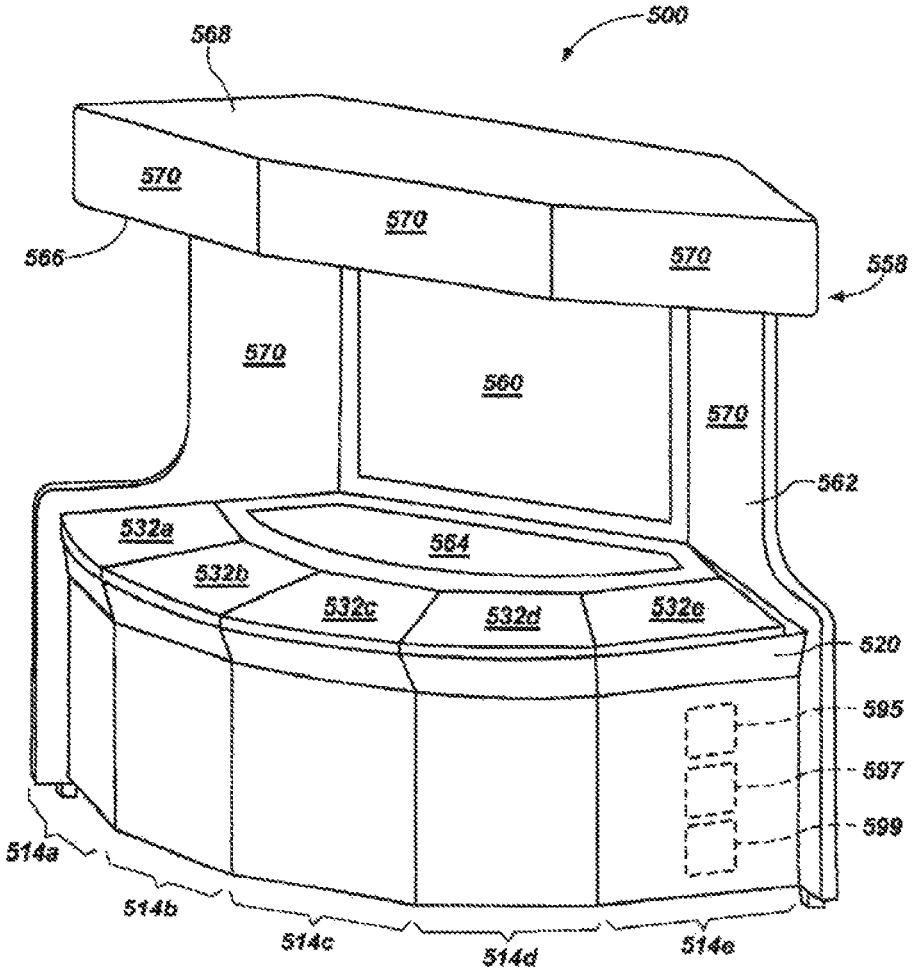
FIG. 6 is an example of a multiple-player, electronic table configured for implementation having a virtual dealer according to the present disclosure is shown.

Referring to FIG. 6, another example of a suitable multiple-player, electronic table 500 configured for implementation of embodiments of wagering games having a virtual dealer according to the present disclosure is shown. The table 500 may include player positions 514*a* through 514*e* that are arranged in a bank about an arcuate edge 520 of a video device 558 that may comprise a roulette wheel screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The roulette wheel screen 564 may be configured to display at least a virtual roulette wheel operated by the virtual dealer on the dealer screen 560.

Each of the player positions 514*a* through 514*e* may include a player interface area 532*a* through 532*e* that is configured for wagering and game play interactions with the video device 558 and/or virtual dealer. Accordingly, game play may be accommodated without involving a physical roulette wheel, physical chips, and/or live personnel. The action may instead be simulated by a control processor 597 interacting with and controlling the video device 558. The control processor 597 may be located internally within, or otherwise proximate to, the video device 558. The control processor 597 may be programmed, by known techniques, to implement the rules of game play at the video device 558. As such, the control processor 597 may interact and communicate with display/input interfaces and data entry inputs for each player interface area 532*a* through 532*e* of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices (not shown) through a suitable communication media, such, as, for example, wired networks, Wi-Fi networks, and cellular communication networks.

The video device 558 may further include banners (not shown) configured to communicate rules of play and/or the like, which may be located along one or more walls 570 of the cabinet 562. The video device 558 may further include additional decorative lights (not shown) and speakers (not shown), which may be located on an underside surface 566, for example, of a generally horizontally depending top 568 of the cabinet 562 of the video device 558 generally extending toward the player positions 514*a* through 514*e*.

Further detail of an example of a table and player displays is disclosed in U.S. Pat. No. 8,272,958. Although an embodiment is described showing individual discrete player stations, in some embodiments, the entire playing surface (e.g., player interface areas 532*a* through 532*e*, roulette wheel screen 564, etc.) may be an electronic display that is logically partitioned to permit game play from a plurality of players for receiving inputs from, and displaying game information to, the players, the dealer, or both.

The system may, for example, enable play of a live game, electronic viewing (by camera and/or data) and distal wagering on the live play (or virtual play) distal game by distal players. In this manner, a single gaming event can be accessed by far more players than can be allowed at a single table.

What is claimed:

1. A wagering system comprising:

a physical roulette wheel;

a source of multiple drop balls;

a selection system that selects a single drop ball from a roulette ball storage area for use in a roulette wagering event;

the roulette ball storage area storing a first roulette ball of a first color in a first accessible area and storing a second roulette ball of a second color in a second accessible area;

a processor having a random number generator;

the processor configured to cause the selection system to randomly select only one roulette ball of a first color or a second color for use in a single event of roulette in which the roulette wheel is spun and the only one roulette ball is delivered onto a track on the spinning roulette wheel to determine a roulette wagering event outcome when the only one roulette ball stops at a numbered position on the roulette wheel;

the processor recognizing wagers on roulette wagering event outcomes and side bets placed at a player position on roulette wagering event outcomes;

the processor configured to resolve wagers as follows:

side bet wagers are always forfeit when placed;

wagers on roulette wagering event outcomes that do not occur are forfeit;

wagers at a player position without the side bet being recognized on roulette wagering event outcomes that do occur are resolved at odds against a first paytable; and wagers at a player position with the side bet being recognized on roulette wagering event outcomes that do occur are resolved at odds against a second paytable that provides odds on at least some winning event outcomes that are higher than odds on the same at least some winning event outcomes in the first paytable.

2. The wagering system of claim 1 wherein the selection system also returns the only one roulette ball to the appropriate storage area for the only one roulette ball.

3. The wagering system of claim 2 wherein both delivery of the only one roulette ball onto a track on the spinning roulette wheel and return of the only one roulette ball to the appropriate storage area for the only one roulette ball is configured to be performed by apparatus directed by the processor.

4. The wagering system of claim 1 wherein the processor provides different weighted probabilities between the first color ball and the second color ball.

5. The wagering system of claim 4 wherein the processor is configured to provide different weighted probabilities between the first color ball and the second color ball at rates of weighted probabilities between 8:1 and 25:1.

6. The wagering system of claim 1 wherein each player position has a player position enabling entry of both a wager on roulette wagering event outcomes and a wager on the side bet.

7. The wagering system of claim 6 wherein indication of entry of both a wager on roulette wagering event outcomes and a wager on the side bet, the processor is configured to decrement credits at the player position by an amount of the wager on roulette wagering event outcomes and a fixed amount for the wager on the side bet.

8. The wagering system of claim 6 wherein indication of entry of both a wager on roulette wagering event outcomes and a wager on the side bet, the processor is configured to decrement credits at the player position by an amount of the wager on roulette wagering event outcomes and an amount for the wager on the side bet that is a predetermined percentage of the wager on roulette wagering event outcomes.

9. The wagering system of claim 8 wherein the processor is configured to base the predetermined percentage on a highest amount of any single wager placed at the player position on a next roulette wagering event outcome.

10. The wagering system of claim 8 wherein the processor is configured to base the predetermined percentage on a minimum allowable total wager allowed on a next roulette wagering event outcome.

11. The wagering system of claim 8 wherein the processor is configured to base the predetermined percentage on an average of all wagers placed at the player position on a next roulette wagering event outcome.

12. The wagering system of claim 8 wherein the processor is configured to base the predetermined percentage on total wagers placed at the player position on a next roulette wagering event outcome.

13. The wagering system of claim 6 wherein the processor provides different weighted probabilities between the first color ball and the second color ball and wherein both delivery of the only one roulette ball onto a track on the spinning roulette wheel and return of the only one roulette ball to the appropriate storage area for the only one roulette ball is configured to be performed by apparatus directed by the processor.

14. The wagering system of claim 13 wherein indication of entry of both a wager on roulette wagering event outcomes and a wager on the side bet, the processor is configured to decrement credits at the player position by an amount of the wager on roulette wagering event outcomes and at least one of a) a fixed amount for the wager on the side bet or b) a fixed percentage of the amount of the wager on roulette wagering event outcomes.

15. The wagering system of claim 6 wherein the processor provides different weighted probabilities between the first color ball and the second color ball.

16. A method of performing a wagering event on a wagering system comprising:

a physical roulette wheel;

a source of multiple drop balls;

a selection system that selects a single drop ball from a roulette ball storage area for use in a roulette wagering event;

the roulette ball storage area storing a first roulette ball of a first color in a first accessible area and storing a second roulette ball of a second color in a second accessible area;

a processor having a random number generator;

the processor configured to cause the selection system to randomly select only one roulette ball of a first color or a second color for use in a single event of roulette in which the roulette wheel is spun and the only one roulette ball is delivered onto a track on the spinning roulette wheel to determine a roulette wagering event outcome when the only one roulette ball stops at a numbered position on the roulette wheel;

the processor recognizing wagers on roulette wagering event outcomes and side bets placed at a player position on roulette wagering event outcomes;

the processor configured to resolve wagers as follows:

side bet wagers are always forfeit when placed;

wagers on roulette wagering event outcomes that do not occur are forfeit;

wagers at a player position without the side bet being recognized on roulette wagering event outcomes that do occur are resolved at odds against a first paytable; and wagers at a player position with the side bet being recognized on roulette wagering event outcomes that do occur are resolved at odds against a second paytable that provides odds on at least some winning event outcomes that are higher than odds on the same at least some winning event outcomes in the first paytable, wherein after a player position has made a wager on the side bet, the method includes steps of the processor randomly selecting a single drop ball from a roulette ball storage area for use in a roulette wagering event, dropping the single drop ball onto a track in a spinning roulette wheel, capturing the single drop ball in a final outcome identifying position on the roulette wheel, and when the randomly selected single drop ball consists of a drop ball of the second color, winning wagers placed at player positions that have made the side bet are resolved against the second paytable.

17. The method of claim 16 wherein after resolution of the winning wagers, the selection system returns the single drop ball to the appropriate storage area for the single drop ball.

18. The method of claim 16 wherein the processor provides different weighted probabilities between the first color ball and the second color ball before the random selection of the single drop ball.

* * * * *